FIP7811 XR 4,025,115

United States Patent [19]

French et al.

[11] 4,025,115

[45] May 24, 1977

[54] METHOD OF ENHANCING RECOVERY OF OIL FROM PILLARS ADJACENT IN SITU OIL SHAFT RETORT

[75] Inventors: Gordon B. French, Rifle; Richard D. Ridley, Grand Junction, both of Colo.

[73] Assignee: Occidental Petroleum Corporation, Los Angeles, Calif.

[22] Filed: Apr. 14, 1975

[21] Appl. No.: 567,481

[52] U.S. Cl. ..... 299/2; 299/13

[51] Int. Cl.[2] ..... E21C 41/10

[58] Field of Search ..... 299/2, 13; 166/247, 166/259

[56] References Cited

UNITED STATES PATENTS

| | | | |
|---|---|---|---|
| 3,434,757 | 3/1969 | Prats | 299/13 X |
| 3,448,801 | 6/1969 | Closmann et al. | 166/247 |
| 3,578,080 | 5/1971 | Closmann | 166/259 X |
| 3,593,788 | 7/1971 | Parker | 166/247 |
| 3,630,278 | 12/1971 | Parker | 166/259 |
| 3,661,423 | 5/1972 | Garret | 299/2 |
| 3,674,313 | 7/1972 | Knutson | 299/13 |
| 3,677,342 | 7/1972 | Silverman | 166/308 |
| 3,777,815 | 12/1973 | Boardman et al. | 299/13 X |
| 3,917,348 | 11/1975 | Janssen | 299/2 |

*Primary Examiner*—Ernest R. Purser

[57] ABSTRACT

An underground in situ oil shale retort contains a bed of fragmented oil shale particles having an appreciable void volume distributed therethrough. Air or other retorting gas passed through this bed of fragmented oil shale supports combustion of some of the carbonaceous material in the oil shale and provides heat for retorting oil therefrom. A number of such retorts may be formed in an area and pillars are left to support the overburden. Pillars forming walls between adjacent retorts also prevent gas leakage. Oil recovery from intact oil shale pillars between retorts is enhanced by fracturing the pillars as well as fragmenting the shale in the retort. The pillars are fractured by detonating explosives in bore holes in the region between the retort and pillars, preferably a fraction of a second after explosive fragmentation of the oil shale in the retort.

24 Claims, 4 Drawing Figures

Fig. 1
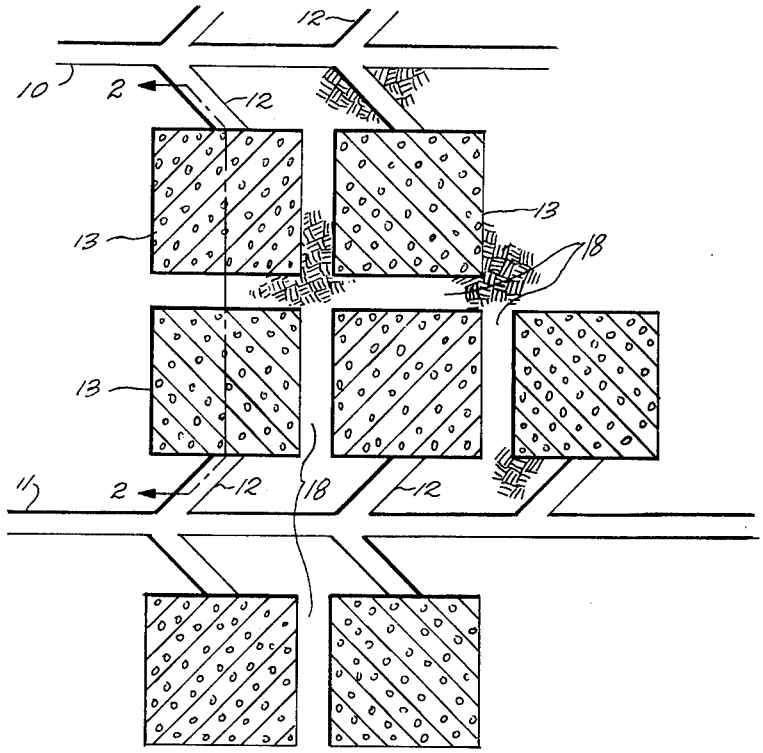
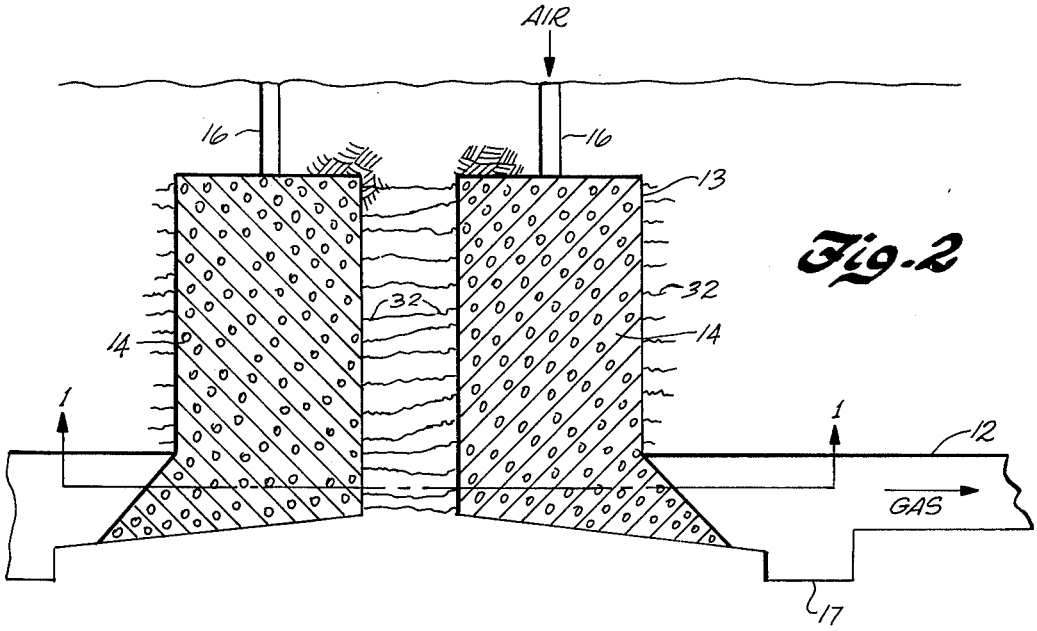
Fig. 2

METHOD OF ENHANCING RECOVERY OF OIL FROM PILLARS ADJACENT IN SITU OIL SHAFT RETORT

BACKGROUND OF THE INVENTION

There are vast deposits of oil shale throughout the world with some of the richest deposits being in the western United States in Colorado, Utah and Wyoming. These reserves are regarded as one of the largest untapped energy reserves available. The oil shale is in the form of solid rock with a solid carbonaceous material known as kerogen intimately distributed therethrough. The kerogen can be decomposed to a synthetic crude petroleum by subjecting it to elevated temperatures in the order of about 700° to 1500° F. This causes the kerogen to decompose to a hydrocarbon liquid, small amounts of hydrocarbon gas, and some residual carbon that remains in the spent shale. Such decomposition by heating in a retort, which can be formed underground in the oil shale deposit, is referred to as retorting.

Heat for retorting the oil shale can be obtained by burning some of the carbonaceous material in the shale with air or other oxygen supplying gas. Preferably the oil shale is retorted in situ in a bed of oil shale particles filling a cavity blasted into the oil shale deposit or formation. In such an in situ retort the rubble pile of oil shale particles is ignited at the top to form a combustion zone and air is passed downwardly through the bed to sustain the combustion zone and retort the oil shale on the advancing side of the combustion zone. Liquid oil flows to the bottom of the retort and is recovered.

As gas flows downwardly through the in situ retort three distinct but overlapping zones are created. One of these zones is the combustion zone in which much of the reaction between oxygen supplying gas and carbonaceous material in the oil shale is occurring. This zone may have appreciable thickness since the rate of combustion is to some extent controlled by the rate of diffusion of oxygen supplying gas and reaction products through solid particles of shale.

Above the combustion zone there is a zone of heated spent shale that can contain a substantial amount of unburned residual carbon. This heated shale remains at an elevated temperature long after the combustion zone has passed. Some combustion does occur in this zone of heated spent shale during retorting by reaction between oxygen and residual carbon.

Below the combustion zone in a typical retort the gas is essentially inert since the oxygen has been removed in the hot spent shale and in the combustion zone. This hot substantially oxygen free gas heats the oil shale in a retorting zone, thereby decomposing the kerogen.

These zones progress downwardly through the retort at a rather slow rate of no more than a few feet per day and retorting of a large in situ retort can proceed for a substantial period of time.

To recover the maximum amount of shale oil from a given area a pattern of adjacent retorts is formed. Each of these retorts is filled with a bed of fragmented oil shale particles. Substantial pillars of unfragmented oil shale are left between adjacent retorts primarily to act as supports for the overburden of rock above the oil shale deposit being retorted. Typically, for example, each retort is a rectangular room filled with oil shale particles and is bounded on all sides by pillars separating it from adjacent retorts. Even with the best possible mining techniques 30 to 40 percent of the oil shale may be left in pillars to support the overburden. In recovery schemes where the oil shale is mined and retorted at the surface all of the shale oil in the pillars is sacrificed. In underground in situ retorting some of the oil in the pillars is recovered due to heat transfer from the combustion zone and hot spent shale. This recovery of oil from the pillars is limited by diffusion rates of heat into the pillar and decomposition products out of the pillar and appreciable amounts of oil may still be left after an area has been completely retorted.

It is therefore desirable to provide a technique for increasing the yield of oil from the pillars of oil shale adjacent in situ oil shale retorts. Such a technique should be sufficiently economical that the cost of the oil is not significantly increased. These techniques should also avoid damage to the structural integrity of the pillars so that mining hazards are not created in the retorting area and ground subsidence of the overburden is avoided. In practice of this invention this is obtained by relatively controlled fracture of essentially intact pillars with faces adjacent the fragmented shale in the in situ retort.

When nuclear devices are detonated underground to create a "chimney" containing rock fragments, there is fracturing of a portion of the rock surrounding the point of detonation of the nuclear device. Detonation pressures plastically and elastically deform surrounding rock, forming a generally spherical cavity with a lining of molten rock. After detonation, the rock above this cavity tends to collapse into the cavity, ultimately creating a vertically elongated chimney containing rock fragments. The deformed rock near this chimney that was subjected to high stresses from the nuclear detonation may contain fractures.

For example, U.S. Pat. No. 3,409,082, by B. G. Bray, et al. for a "Process for Stimulating Petroliferous Subterranean Formations with Contained Nuclear Explosions" states that the pressure waves from the explosion result in fractures in the rocks surrounding and above the detonation location. This complex fracture system results in an increase in the permeability of the matrix rock. Such fracturing is substantially uncontrolled since it is an inherent byproduct of the nuclear detonation. It is believed that most such fracturing is near the point of detonation although minor fractures may extend for a large distance towards the ground surface, as indicated in FIG. 1 of that patent.

Other patents, such as, for example, U.S. Pat. No. 3,698,478 by Harry W. Parker, entitled "Retorting of Nuclear Chimneys", suggest by the drawings that fracturing of the rock around a nuclear chimney is uniform throughout the height. It is believed that this is only a semi-schematic representation and not indicative of an observed effect.

BRIEF SUMMARY OF THE INVENTION

There is, therefore, provided in practice of this invention according to a presently preferred embodiment a method for enhancing the ease of flow of shale oil from oil shale pillars having faces adjacent the fragmented or rubblized oil shale in an in situ retort by detonating explosives in the volume of shale to become an in situ retort for fragmenting at least part of the oil shale therein to have substantial gas permeability and shortly thereafter detonating explosives adjacent the pillars of oil shale adjacent the fragmented shale in the retort for generating minor fissures or fractures in the pillars.

Preferably the explosives for fissuring the pillars are detonated a fraction of a second after detonation of the explosives for fragmenting the oil shale, and may participate in fragmenting at least a part of the oil shale in the retort.

These and other features and advantages of the present invention will be appreciated as the same becomes better understood by reference to the following detailed description of a presently preferred embodiment when considered in connection with the accompanying drawings wherein:

FIG. 1 is a semi-schematic horizontal cross section illustrating a number of in situ oil shale retorts;

FIG. 2 is a semi-schematic vertical cross section illustrating a pair of in situ oil shale retorts;

DESCRIPTION

Figure 3:
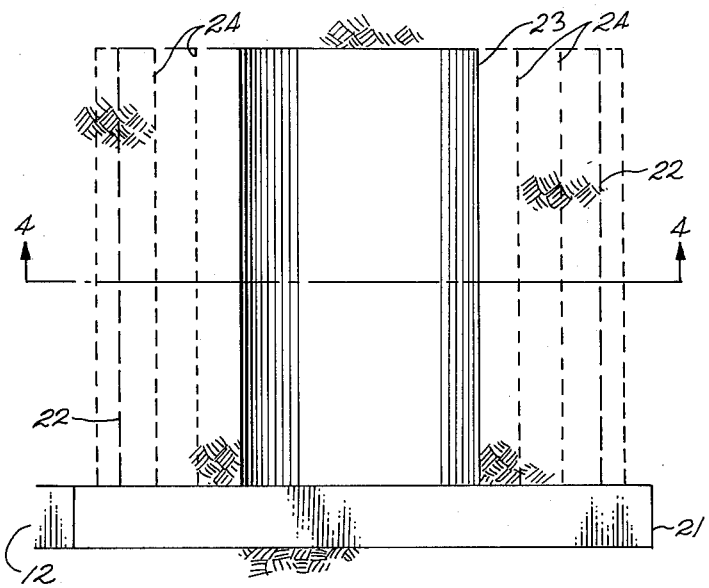
FIG. 3 is a semi-schematic vertical cross section illustrating a preliminary step in forming an in situ retort.

FIGS. 1 and 2 are horizontal and vertical semi-schematic cross sections of a number of underground or in situ oil shale retorts prepared in accordance with principles of this invention. As illustrated in this presently preferred embodiment, a pair of parallel access tunnels 10 and 11 are formed in the undisturbed oil shale deposit or formation. A number of lateral drifts 12 are provided from each of the access tunnels. Each drift leads to an individual in situ oil shale retort 13. The illustrated retorts are square or nearly square in horizontal cross section and have a pair of sides substantially parallel to the access tullels 10 and 11. The lateral drifts 12 are conveniently arranged at about 45° from the access tunnels to facilitate the movement of mining equipment.

Each in situ retort is a cavity substantially filled with a bed of fragmented oil shale particles 14. The bed or rubble pile of oil shale particles is created explosively as described in greater detail hereinafter. A conduit 16 communicates with the interior of each retort 13 at the top and during retorting operations air or other retorting gas is introduced through the conduit for retorting the oil shale in the respective retort. Flue gas or off gas from the bottom of each retort is recovered through the respective drift 12. Gas tight bulkheads (not shown) are typically mounted in the drifts during retorting operations to control gas in the access tunnels. A sump 17 is provided in each drift for recovering oil from the adjacent retort.

The adjacent in situ retorts 13 are spaced apart by "pillars" 18 of unfragmented oil shale. Pillars are commonly left in underground mining operations so that the compressive strength of the remaining rock supports the overburden above the pillars and above mined out areas. In a retort of large cross-sectional dimensions, one or more pillars (not shown) of square, circular or other cross section can be located within the gas retaining walls of the retort. In the case of in situ oil shale retorting the retort volume is not completely mined out, but the blasting pattern creates the boundaries defining the retort and simultaneously fills it with a rubble pile of fragmented oil shale. Thus, after blasting the retort volume filled with fragmented oil shale may still have substantial capability for supporting overburden. Since the fragmented shale in the in situ retort can still support at least part of the overburden and also provide lateral support for the pillars, the pillars can be made narrower than in a mine where the fragmented shale is removed for retorting above ground. It will be noted from FIG. 1 that the illustrated pillars form the boundaries of the retorts and separate them from each other. Thus, they also serve as barriers to inhibit or prevent the flow of gas between adjacent retorts.

Undisturbed oil shale has little natural porosity and flow of gas or oil through the shale is quite slow. Heat transferred from the fragmented oil shale in a retort into the pillars decomposes the kerogen therein and the resultant gas and oil must diffuse through a portion of the pillar into the fragmented oil shale in the retort to be recovered. It might be noted that retorting and decomposing kerogen increases the permeability of the shale. Diffusion of the decomposition products through spent shale is, therefore, more rapid than through unretorted shale. For this reason oil and gas generated in the pillars diffuse, albeit slowly, primarly towards the heated retort rather than more deeply into the pillar. It is desirable to enhance the diffusion of oil and gas from the pillars to speed up recovery, increase yield, and further to minimize the exposure of oil to higher temperatures which can cause cracking of the hydrocarbons.

Figure 4:
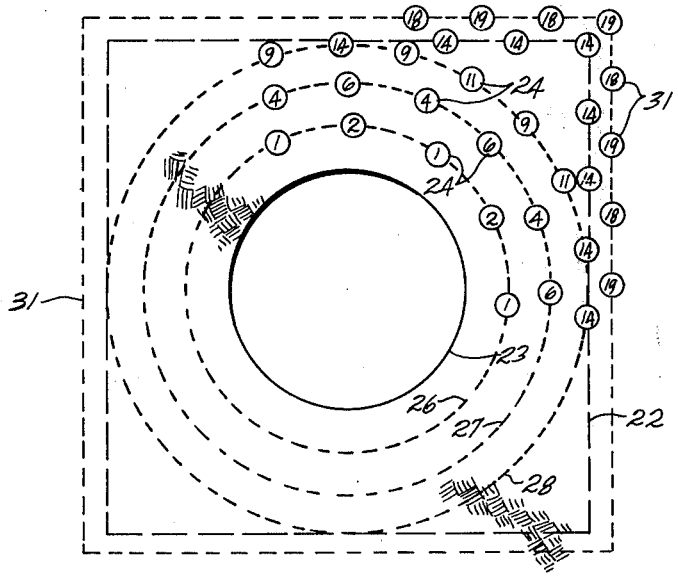
FIG. 4 is a semi-schematic horizontal cross section on line 4—4 of FIG. 3.

FIGS. 3 and 4 illustrate semi-schematically in vertical and horizontal cross sections, respectively, the arrangement in a retort volume immediately preceding the blasting that fragments the oil shale and creates the retort. Additional details of the mode of forming a retort are set forth in U.S. patent application Ser. No. 505,457, filed Sept. 12, 1974, entitled "Method of Fragmenting Ore For In Situ Recovery of Consituents", by Gordon French, and assigned to Occidental Petroleum Corporation, assignee of this application. As illustrated in this embodiment, a room 21 is mined out by conventional mining techniques at the bottom portion of the volume to become the oil shale retort. In the illustrated embodiment, the room 21 is at the bottom of the ultimate retort volume. Other arrangements with the room at the top or in an intermediate portion of the retort are also suitable. Support pillars of oil shale may be left within the room to protect mining operations.

The transverse dimensions of this room 21 are approximately the same as the horizontal cross section of the retort to be formed. The final retort boundaries are indicated by the longer dashed lines 22. When a pillar is located within the outer boundaries of an in situ retort, there will also be boundaries between the face or faces of such pillar and the adjacent fragmented oil shale in the retort. The room 21 may be slightly larger than the final retort cross section to permit access of drilling equipment near the walls. Access to the room 21 is through the lateral tunnel 12 from which oil and gas are subsequently recovered. The height of the room is only sufficient to accommodate the drilling equipment needed for preparing blast holes.

A center cylindrical raise 23 is mined out above the room 21 by conventional raise forming techniques. If the room 21 is above the ultimate retort volume a shaft corresponding to the raise may be sunk from the room or a raise may be formed by raise forming techniques. Typically the volume of the raise 23 is in the order of about 10 to 25 percent of the total volume of the retort to be formed. When the oil shale in the retort is fragmented by blasting, the void volume of the raise 23 and room 21 becomes distributed between the oil shale fragments. Thus, for example if the total volume of the raise and room is about 20 percent of the ultimate retort volume, the rubblized bed of fragmented oil shale will have an average void volume of about 20 percent distributed therein. The blasting causes the oil shale fragments to be displaced and the shale "bulks up" to completely fill the retort volume.

A number of blast holes 24 within the retort volume are drilled from the room 21 parallel to the raise 23. As seen in the horizontal cross section of FIG. 4 a number of these holes are drilled in a ring 26 concentric with the raise. Another ring of holes 27 is provided around this inner ring and a third outer ring 28 is provided around this one. Additional rings of blast holes may be provided but it is preferred to keep the number as small as feasible because of timing difficulties that are encountered as larger number of rings are employed. Additional blast holes are drilled along the boundaries 22 of the retort volume. These blast holes are typically in the range of from about 2 to 6 inches in diameter and extend the full vertical height of the retort to be formed.

The blast holes are loaded with conventional mining explosives such as dynamite, explosive slurries, or a mixture of ammonium nitrate and fuel oil (ANFO). Electrical detonators are provided in each blast hole for initiating the mining explosion.

Preferably conventional time delay detonators are used so that the charge in the blasting holes is detonated in the following sequence of steps:

a. ring 26;
b ring 27;
c. ring 28;
d. border 22 with the exception of the corner holes; and
e. the corner holes of border 22.

Thus, the shale adjacent the raises 23 is explosively expanded into the raise and to some extent into room 21 in concentric rings moving outwardly from the raise. Blasting in concentric rings with time delay therebetween is used so that each ring is blasting to a "free face" or an interface between rock and void volume. This is of importance since appreciable fragmenting of rock by conventional explosives is obtained only when the explosive force can interact with a free face. A series of rings of explosives are needed because of limitations of the volume of shale between the free face and blasting hole that can be moved by the quantity of explosives a hole of given diameter can accommodate.

Thus, the time delay between each of the above steps is sufficiently large, e.g. 100 to 150 milliseconds to permit the layer of shale between each ring to completely break away from the remaining shale surrounding it, thereby creating a new free face, prior to detonation of the next ring of blasting holes. This assures that the shale fragments rather than simply fracturing. On the other hand the time delay between each of the above steps is preferably small enough that the layers of shale do not fall appreciably before the blasting sequence is completed. This assures a desired horizontal uniformity of the permeability of the fragmented shale in the retort.

Within each ring of blast holes there is small delay, e.g. from 25 to 100 milliseconds between detonation of alternate holes to cause the shale to break up vertically in the vicinity of the holes to provide better fragmentation. The detonators for the blasting holes are provided with conventional delay fuses that are triggered simultaneously. The numbers of these delay fuses are indicated in FIG. 4 inside the respective blasting holes. (These holes are drawn larger than actual scale to accommodate the numbers and fewer holes than present in a full scale retort are shown in the drawing.) As measured from the instant of triggering the fuses, the following correspondence between fuse numbers and time delays exists:

| Fuse Number | Time Delay |
|---|---|
| 1 | 25 Milliseconds |
| 2 | 50 |
| 4 | 100 |
| 6 | 150 |
| 9 | 250 |
| 11 | 350 |
| 14 | 500 |
| 17 | 800 |
| 18 | 900 |
| 19 | 1000 |

A band of blast holes 31 is provided around the perimeter of the retort volume adjacent the surrounding pillars 18. As illustrated in FIGS. 3 and 4, these additional blasting holes 31 are spaced slightly outwardly of the final retort perimeter 22 so as to actually be in the edges of the pillars that remain unfragmented when the retort is formed. In one embodiment, the pillar between a pair of adjacent retorts is about 40 feet thick. The surrounding blasting holes 31 are spaced outwardly from the retort boundary 21 a distance of about 4 to 5 feet. Thus, they are between the boundary of the retort and the principal portion of the pillar. In a pillar within the retort boundaries there may be similar spacing of the additional blasting holes.

The outer band of blasting holes 31 is loading with explosives and provided with alternating time delay detonators such as the No. 18 and 19 detonators indicated in FIG. 4. This causes the explosives in the outer band of holes to be detonated a short time after the main blasting that forms the retort cavity and fragments the shale therein.

The outer band of blasting holes 31 should be heavily loaded with explosives to obtain as much fissuring 32 as possible in the pillars without significant fragmenting. "Fragmenting" and "fracturing" should be distinguished. When the oil shale is fragmented, it is broken into individual pieces and moved an appreciable distance from its original location. Many of the pieces also change orientation somewhat or are displaced relative to adjacent pieces so that the particles occupy considerably more volume than the unfragmented rock due to the volume of the void spaces between particles. When oil shale is fractured small fissures are produced and there may be some displacement of the pieces of oil shale to accommodate the relatively small void volume in these fissures. The particles change orientation only slightly, if at all, so that the fissures have relatively small void volume.

Other terms used in the blasting art may also be noted. "Pulling" refers to the displacement of the rock (shale oil in this case) towards the free face when the explosives detonate. "Burden" refers to the mass of rock between the explosives and the free face that is displaced or "pulled" by the explosive. The burden may also include some rock on the opposite side of the explosives from the free face that is shattered and pulled by the blast. "Relief" refers to the extent that rock pulled by the explosives can move before encountering resistance from surrounding rock, such as, for example, the burden being pulled by a previous blast several milliseconds earlier.

In a blasting sequence as illustrated in FIG. 4, when the innermost ring of blast holes 26 is detonated, the oil shale has considerable relief since it can expand into the central raise 23. The particles of fragmented shale can move a considerable distance and undergo appreciable changes in orientation to occupy the void volume. When the next ring 27 of explosives is detonated there is somewhat less relief for the oil shale between two rings 26 and 27 and the burden between these rings may be pulled a shorter distance than the burden inside the innermost ring 26. This effect continues with each sequential ring outwardly so that the relief for the final band of explosives at the boundary of the retort volume may be relatively smaller than for the innermost ring.

It will be noted that the outermost band of blasting holes along the retort boundary 22 has the same time delay for detonation in all of the holes. (The blasting holes in the corners may be detonated slightly later in some embodiments to assure adequate relief.) These boundary holes are as fully loaded with explosives as all of the other blasting holes in the retort volume and may be spaced closer together than other holes. When this band is detonated the intersecting shocks from adjacent holes causes a splitting of the rock between the holes much as occurs in conventional presplitting. This band of holes is, however, fully loaded with explosives since it must also pull the burden between the band and the outermost ring 28 of blasting holes. This simultaneous detonation of the outermost band of blasting holes around the retort provides a relatively smooth wall for the retort volume. Some slabs of oil shale may be produced in the retort because of the simultaneous detonation of adjacent blasting holes since fragmenting is ordinarily augmented by using alternating delays as in the inner explosive rings of the preferred embodiment. Any slabs produced adjacent the retort walls are generally oriented along the length of the retort, however, and do not significantly interfere with retorting gas flow. This technique is to be distinguished from one sometime used in large scale mining known as presplitting. Such a technique is used for isolating large blasts from the adjacent walls and minimizing the fracturing that may occur in these walls. The presplitting technique is used where the fragmented material is removed and the overburden must be supported by the integrity of the adjacent pillars.

In the presplitting technique a number of blasting holes are drilled into the intact rock to define the boundary of the volume to be fragmented. Blasting holes are also distributed through the volume of rock to be fragmented in any of a variety of patterns found to give good fragmenting. Ordinarily the holes in the presplitting band are smaller than the balance of the holes in the rock to be fragmented and/or loaded with an appreciably lower proportion of explosives. At the time of blasting, the band of presplitting holes is first exploded to develop a fracture that extends along the boundary of the rock to be fragmented. All of the presplitting charges are detonated simultaneously. By keeping the presplitting holes relatively close together and loading with a light charge of explosives, the amount of fracturing in the walls is minimized. A short time later the principal blasting charge for fragmenting the rock is detonated. The initial presplitting fracture along the walls provides an interface that inhibits propagation of the shock waves from this more massive explosion. This "decoupling" of the principal explosion from the walls protects the integrity of the pillars that will remain in the mine after the fragmented rock as been removed. The technique provided in practice of this invention differs in that it is desired to maximize fracturing of the pillars while avoiding fragmenting.

A presplitting technique applied to underground mining of oil shale is described in U.S. Pat. No. 3,466,094 to Haworth, et al.

The band of holes 31 in the pillars outside the boundary of the retort are heavily loaded with explosives and are provided with alternating time delay fuses so that adjacent blast holes do not explode simultaneously. The alternating delays cause more fracturing of the oil shale than would be obtained if the entire band were exploded simultaneously. The blasts in this outer band pull the burden between the band of holes and the boundary 22 of the retort. This burden cannot move any substantial distance, however, since the relief available at the boundary of the retort volume is minimal. There is insufficient relief for appreciable fragmenting of the oil shale outside the retort volume and only fracturing with production of some open fissures occurs in the burden. Shale oil and gaseous hydrocarbons produced in the volume of oil shale so fractured can flow through these fissures into the retort as it is operated. The heavy explosive loading in the band of holes in the pillars assures fracturing of the pillars rather than preventing it as is desired in presplitting. Since the fracturing holes are located in the pillars rather than along the boundary of the rock to be fragmented, a great degree of fracturing is obtained for enhanced recovery of carbonaceous material from the pillars. Some of the fracturing extends into the principal portion of the pillars beyond the band of blast holes surrounding the retort volume as a result of loading the holes with a full charge of explosives and using alternating delays.

The fracturing in the pillars due to detonation of the surrounding band of fracturing holes 31 provides regions of enhanced porosity through which oil and gas produced from the kerogen can diffuse with greater ease than through completely undisturbed shale. The absence of appreciable fragmenting in the pillars that remain in place leaves their compressive strength essentially intact so that there is continued support of the overburden. Since the rubble pile of fragmented shale in the retort remains in place there is no safety hazard introduced by the fracturing of the support pillars.

In an exemplary embodiment an in situ retort about 120 feet square and over 300 feet tall is formed in an oil shale formation. A room and raise are formed in accordance with the above described mining operations. Blasting holes are drilled in the oil shale above the room and loaded with explosives. Detonation of the explosives fragments the oil shale in the retort volume and expands it into the void spaces of the raise and room. Detonation of the outermost band of blasting holes causes fracturing and fissuring in the otherwise intact pillars to enhance the ease of fluid passage without substantially increasing the void volume of the fractured oil shale.

The top of the rubble pile of oil shale particles in the retort is ignited by any of a variety of techniques, many of which are conventional or by one of the methods described in copending applications Ser. No. 492,593, entitled "Method for Igniting Oil Shale Retort" now U.S. Pat. No. 3,952,801 and Ser. No. 492,600, entitled "Burner for Igniting Oil Shale Retort", now U.S. Pat. No. 3,990,835 both filed on July 16, 1974, by Robert S. Burton, III and assigned to the same assignee as the present invention.

Oxygen-supplying gas which is generally air diluted somewhat with inert or reducing gas (such as retort off gas) is forced into the top of the retort and flue gas or off gas is withdrawn from the bottom. This downward flow of gas generates heat of combustion as the oxygen-supplying gas reacts with hot carbonaceous material in the oil shale in a combustion zone. This heat is carried down by flowing gas and heats oil shale in a retorting zone below the combustion zone, kerogen is decomposed in the retorting zone to yield shale oil which percolates to the bottom of the retort for recovery and gases which mix with gas from the combustion zone and are withdrawn for the bottom of the retort as off gas.

Heat from the combustion zone and from a zone of heated spent shale trialing the combustion zone diffuses into the pillars of fractured but otherwise intact oil shale. Kerogen in the pillars decomposes and the resulting oil and gas gradually reach the fractures and flow into the retort volume for recovery with products from the retorting zone.

If desired, the fragmented oil shale in the retort can be heated and retorted by other retorting gas such as, for example, hot oxygen-free gas. Similarly, although described with respect to a vertical in situ retort, principles of this invention are useful in other orientations of retort. For example, the principal length of the retort may be tilted to accomodate the dip of an oil shale deposit. Similarly, the preferred retorts are described as square in horizontal cross section but clearly other polyhedral, circular or oval cross sections may also be employd in other embodiments.

Although limited embodiments of explosive techniques for fracturing oil shale in pillars adjacent a retort volume have been described and illustrated herein many mofification and variations will be apparent to one skilled in the art. Thus, for example, the surrounding fracturing band of blasting holes may be angled into the pillars rather than being exactly parallel to those blasting holes used for fragmenting the shale. This can ease the requirement for drilling space in the room in the retort volume.

It will also be apparent that blasting in the pillars can be conducted after the oil shale in the retort is fragmented. It is preferred, however, to blast in the pillars immediately after detonation of the fragmenting explosives to minimize down time of mining operations and avoid hazardous working conditions that may prevail after the large retort blast. Further, if the pillars are blasted long after the fragmenting explosion, the relief available may not be enough to leave good open fissures for oil and gas flow. Absent some small relief, which is present with the above mentioned time delays, fracturing may be more isolated near the blast holes 31 and not induce as much fracturing that communicates with the retort cavity.

It should also be noted that the pillars can be fractured by explosives in blast holes around the boundary of the retort before fragmenting. In such an embodiment alternating time delay fuses are used in the blast holes to minimize preshearing while still getting extensive fracturing. The quantity of explosives and numbers of blast holes may also be larger than in an embodiment where detonation is immediately after fragmenting. Preferably, the blast holes along the boundary 22 are all detonated simultaneously to obtain a relatively smooth retort boundary and minimize fragmenting of the oil shale fractured by previous detonation of the blast holes in the pillars. The blasting in the pillars can be either immediately before the fragmenting blasting or can precede it by very long times.

It will also be apparent that this technique for fracturing the pillars is adaptable to a retort forming blasting technique where presplitting is used. In such an embodiment the band of blast holes along the retort boundary 22 is lightly loaded and detonated first with adjacent ones of the blast holes being detonated simultaneously. Thereafter, the principal fragmenting blasting in the retort volume is conducted either by a technique as described above or with other arrangements of void volume and blasting holes. Shortly thereafter the band of blast holes in the pillars is detonated with adjacent blast holes having a short time delay therebetween to promote fracturing.

Another arrangement for forming voids and fragmenting oil shale in an in situ oil shale retort is described in copending U.S. patent application Ser. No. 567,509 entitled "Fracturing of Pillars for Enhancing Recovery of Oil From In Situ Oil Shale Retort" which is being filed concurrently herewith by Donald E. Garrett, and assigned to the same assignee as this application. The disclosure of that application is hereby incorporated by reference. That application describes fracturing pillars having faces adjacent an in situ retort by several different techniques.

Many other modifications and variations will be apparent to one skilled in the art and it is therefore to be understood that within the scope of the appended claims the invention may be practiced otherwise than as specifically described.

What is claimed is:

1. A method for recovery of shale oil from a fragmented permeable mass of particles in an in situ oil shale retort in a subterranean formation containing oil shale and from fractured unfragmented formation containing oil shale adjacent the fragmented permeable mass, said retort having pillars of a first portion of unfragmented formation defining boundaries for the fragmented permeable mass of particles, said fragmented permeable mass being obtained by fragmenting at least part of a second portion of the formation within such boundaries, comprising the steps of:

excavating a part of the second portion of the formation to form at least one void and leaving a remaining unfragmented part of said second portion extending away from such an excavated void;

explosively expanding said remaining part of said second portion toward such as excavated void for forming the fragmented permeable mass of particles;

explosively fracturing unfragmented formation containing oil shale in the first portion adjacent the second portion; and retorting the fragmented permeable mass of particles containing oil shale and fractured formation containing oil shale adjacent to the fragmented permeable mass for recovering carbonaceous products including shale oil therefrom.

2. A method as defined in claim 1 wherein the explosively fracturing step comprises:

forming at least one blasting hole in the first portion adjacent the second portion;

loading such a blasting hole with sufficient explosives for generating fissures in the formation containing oil shale adjacent thereto; and detonating the explosives.

3. A method as defined in claim 2 wherein the explosively expanding step comprises forming at least one blasting hole in said remaining part, loading such a blasting hole with explosives and detonating such explosives for forming at least a portion of the fragmented permeable mass; and wherein the explosives in the first portion are detonated a fraction of a second after detonating the explosives in said remaining part.

4. A method as defined in claim 2 wherein the explosively fracturing step comprises forming a plurality of blasting holes in the first portion adjacent the second portion, loading such blasting holes with explosives and detonating the explosives in the blasting holes in the first portion with different time delays between adjacent blasting holes for fracturing formation containing oil shale between such blasting holes and the fragmented permeable mass.

5. A method as defined in claim 1 which comprises the additional steps of forming a band of blasting holes along such a boundary, loading sufficient explosive into said blasting holes and detonating the explosives in said blasting holes simultaneously for shearing between said blasting holes.

6. A method as defined in claim 1 further comprising forming blasting holes along such a boundary, loading explosives in such blasting holes and detonating the explosives in such blasting holes; and wherein the explosively fracturing step comprises forming blasting holes in the first portion adjacent such boundary, loading such blasting holes with sufficient explosives for generating fissures in the formation between the blasting holes in the first portion and the blasting holes along the boundary, and detonating such explosives with different time delays between adjacent blasting holes in the first portion, and with the same time delays for at least a portion of the blasting holes in the first portion and adjacent blasting holes along such boundary for fracturing formation containing oil shale between the blasting holes in the first portion and the blasting holes along such boundary.

7. A method for recovering shale oil from a fragmented permeable mass of particles containing oil shale in an in situ oil shale retort in a subterranean formation containing oil shale and from fractured unfragmented formation containing oil shale adjacent the fragmented permeable mass, said retort having pillars of a first portion of unfragmented formation defining boundaries for the fragmented permeable mass of particles, said fragmented permeable mass being obtained by fragmenting at least part of a second portion of the formation within such boundaries, comprising the steps of:

excavating a part of the second portion of the formation to form at least one void and leaving a remaining unfragmented part of said second portion extending away from such an excavated void;

explosively expanding said remaining part of said second portion toward such an excavated void for forming the fragmented permeable mass of particles;

placing explosives in the first portion of unfragmented formation containing oil shale;

detonating the explosives for generating fissures in the first portion;

retorting the fragmented permeable mass of particles containing oil shale in the in situ retort and fractured formation adjacent to the fragmented permeable mass; and recovering carbonaceous products including shale oil from the retort.

8. A method as defined in claim 7 wherein the placing and detonating steps comprise:

forming a plurality of blasting holes in a band in the first portion of unfragmented formation containing oil shale adjacent the retort;

loading the blasting holes with a sufficient volume of explosives for generating fissures in the first portion; and detonating the explosives in said blasting holes.

9. A method as defined in claim 8 wherein the explosively expanding step comprises forming at least one blasting hole in said remaining part, loading such a blasting hole with explosives and detonating such explosives for forming at least a portion of the fragmented permeable mass; and wherein the explosives in the first portions are detonated a fraction of a second after detonating the explosives in said remaining part.

10. A method as defined in claim 8 further comprising the steps of:

forming a plurality of blasting holes in a band at such a boundary betwen the fragmented permeable mass of particles containing oil shale being formed and the first portion;

loading the blasting holes in the boundary with explosives; and simultaneously detonating the explosives in adjacent ones of the blasting holes on the boundary for at least partly explosively expanding said remaining part.

11. A method as defined in claim 10 wherein the explosives in adjacent ones of said blasting holes in the first portion are detonated with a time delay therebetween.

12. A method as defined in claim 11 wherein the explosively expanding step comprises forming at least one blasting hole in said remaining part, loading such a blasting hole with explosives and detonating such explosives for forming at least a portion of the fragmented permeable mass; and wherein the explosives in the first portion are detonated a fraction of a second after detonating the explosives in said remaining part.

13. A method as defined in claim 8 wherein the explosives in adjacent ones of said blasting holes in the first portion are detonated with a time delay therebetween.

14. A method for recovery of shale oil from a fragmented permeable mass of particles in an in situ oil shale retort in a subterranean formation containing oil shale and from fractured unfragmented formation containing oil shale adjacent the fragmented permeable mass, said retort having pillars of a first portion of unfragmented formation defining boundaries for the fragmented permeable mass of particles, said fragmented permeable mass being obtained by fragmenting part of a second portion of the formation within said boundaries, comprising the steps of:

excavating a part of the second portion of the formation to form at least one void and leaving a remaining unfragmented part of said second portion extending away from such an excavated void;

placing explosives in the remaining unfragmented part of the second portion;

placing explosives along the boundary between the first portion and the second portion;

placing explosives in at least a portion of the first portion of unfragmented formation containing oil shale adjacent the second portion;

detonating the explosives in the second portion for fragmenting thereof;

detonating the explosives along the boundary; and thereafter detonating the explosives in the first portion for fracturing at least a part of the first portion; and retorting the fragmented permeable mass of particles containing oil shale and fractured formation containing oil shale adjacent to the fragmented permeable mass for recovering carbonaceous products including shale oil therefrom.

15. A method as defined in claim 14 wherein explosives along the boundary are detonated simultaneously.

16. A method as defined in claim 14 wherein the explosives along the boundary are detonated after detonating the explosives in the second portion.

17. A method as defined in claim 14 wherein the explosives in the first portion are in a plurality of blasting holes and the explosives in adjacent ones of the blasting holes in the first portion are detonated with a time delay therebetween.

18. A method as defined in claim 17 wherein explosives along the boundary are detonated simultaneously.

19. A method as defined in claim 18 wherein the explosives along the boundary are detonated after detonating the explosives in the second portion.

20. A method as defined in claim 19 wherein the explosives along the boundary are detonated a fraction of a second after detonating the explosives in the second portion; and the explosives in the first portion are detonated a fraction of a second after detonating the explosives along the boundary.

21. A method for enhancing the ease of flow of shale oil from pillars of unfragmented formation adjacent a fragmented permeable mass of particles in an in situ oil shale retort in a subterranean formation containing oil shale, wherein said retort has pillars of a first portion of unfragmented formation defining boundaries for the fragmented permeable mass of particles and said fragmented permeable mass is obtained by fragmenting part of a second portion of the formation within such boundaries, comprising:

forming a plurality of blasting holes in a pillar adjacent the second portion;

loading the blasting holes with explosives;

detonating the explosives in the blasting holes with explosives in adjacent blasting holes being exploded at different times for fracturing the pillars without appreciable fragmenting;

forming an in situ oil shale retort containing a fragmented permeable mass of oil shale particles adjacent the fractured pillar;

retorting the fragmented permeable mass of oil shale particles by heating the fragmented mass of oil shale particles and adjacent pillar; and recovering carbonaceous products including shale oil from the retort.

22. A method as defined in claim 21 wherein the explosives in the first portion are detonated before the retort is formed.

23. A method as defined in claim 22 wherein the step of forming the retort comprises:

forming a plurality of blasting holes along the boundary between the first and second portions;

loading the blasting holes along the boundary with explosives; and detonating the explosives in the blasting holes along the boundary simultaneously.

24. An in situ oil shale retort in a subterranean formation containing oil shale comprising:

a fragmented permeable mass of particles containing oil shale in the subterranean formation having unfragmented formation defining boundaries for the fragmented permeable mass of particles, wherein at least a portion of the unfragmented formation defining such boundaries constitutes at least one pillar of unfragmented formation having boundaries within the outer boundaries of the fragmented permeable mass, and at least a portion of the unfragmented formation has fractures formed by detonating explosives in such a pillar of unfragmented formation adjacent such a boundary of the fragmented permeable mass of particles.

* * * * *

UNITED STATES PATENT AND TRADEMARK OFFICE

CERTIFICATE OF CORRECTION

PATENT NO. : 4,025,115

DATED : May 24, 1977

INVENTOR(S) : Gordon B. French

It is certified that error appears in the above-identified patent and that said Letters Patent are hereby corrected as shown below:

In the title, "SHAFT" should be -- SHALE --.

Column 5, line 36, "raises" should be -- raise --.

Column 9, line 20, "trialing" should be -- trailing --.

Column 9, line 36, "employd" should be -- employed --.

Column 9, line 40, "mofification" should be -- modification --.

Column 12, line 30, "betwen" should be -- between --.

Signed and Sealed this

*second* Day of *August 1977*

[SEAL]

*Attest:*

RUTH C. MASON
*Attesting Officer*

C. MARSHALL DANN
*Commissioner of Patents and Trademarks*